US011192374B2

(12) United States Patent
Tanaka

(10) Patent No.: US 11,192,374 B2
(45) Date of Patent: Dec. 7, 2021

(54) INK JET RECORDING APPARATUS CAPABLE OF SUPPRESSING OVERFLOW OF INK FROM AN ABSORBER EVEN IF THE APPARATUS IS ARRANGED AT AN ANGLE

(71) Applicant: CANON KABUSHIKI KAISHA, Tokyo (JP)

(72) Inventor: Yusuke Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/828,499

(22) Filed: Mar. 24, 2020

(65) Prior Publication Data

US 2020/0316946 A1 Oct. 8, 2020

(30) Foreign Application Priority Data

Apr. 3, 2019 (JP) ..... JP2019-071349

(51) Int. Cl.
*B41J 2/165* (2006.01)
*B41J 2/21* (2006.01)
*B41J 2/17* (2006.01)

(52) U.S. Cl.
CPC ..... *B41J 2/16523* (2013.01); *B41J 2/16508* (2013.01); *B41J 2/2103* (2013.01); *B41J 2002/1742* (2013.01)

(58) Field of Classification Search
CPC ..... B41J 2/16523; B41J 2002/1742; B41J 2/16508; B41J 2/2103
See application file for complete search history.

(56) References Cited

U.S. PATENT DOCUMENTS

2003/0063152 A1* 4/2003 Edamura ..... B41J 2/1752 347/36
2005/0200650 A1* 9/2005 Inokuchi ..... B41J 2/16526 347/37
2015/0091978 A1* 4/2015 Satoh ..... C09D 11/322 347/31
2016/0288505 A1* 10/2016 Tsukuda ..... B41J 2/1721

FOREIGN PATENT DOCUMENTS

JP 2004-345249 A 12/2004
JP 2015-223764 A 12/2015

* cited by examiner

*Primary Examiner* — Justin Seo
(74) *Attorney, Agent, or Firm* — Canon U.S.A., Inc. I.P. Division

(57) ABSTRACT

An ink jet recording apparatus performs a recording operation by ejecting ink from a recording head. The apparatus includes a first absorber configured to absorb ink, a second absorber disposed apart from the first absorber having a larger ink absorption capacity than the first absorber, and a flow path portion that does not absorb ink. The second absorber has a second lower end portion arranged below a first lower end portion of the first absorber. The flow path portion connects the first lower end portion and a portion of the second absorber below the first lower end portion. As a result, ink is prevented from overflowing from the absorbers, even if an apparatus is arranged at an angle.

14 Claims, 12 Drawing Sheets

INK JET RECORDING APPARATUS CAPABLE OF SUPPRESSING OVERFLOW OF INK FROM AN ABSORBER EVEN IF THE APPARATUS IS ARRANGED AT AN ANGLE

BACKGROUND OF THE DISCLOSURE

Field of the Disclosure

The present disclosure relates to an ink jet recording apparatus configured to eject ink to record an image.

Description of the Related Art

Japanese Patent Application Laid-Open No. 2004-345249 discusses a configuration in which a sponge arranged on a platen to absorb ink and an ink collection device that collects the ink absorbed by the sponge are connected by a felt. Due to the capillary force of the felt, the ink absorbed by the sponge moves to the ink collection device and thus, the ink can be collected in the ink collection device having a larger absorption capacity than the sponge.

However, in the configuration discussed in Japanese Patent Application Laid-Open No. 2004-345249, if a printer is arranged at an angle, the ink may return from the ink collection device to the sponge due to the capillary force of the felt. As a result, ink that cannot be held by the sponge may overflow into a printer main body.

SUMMARY OF THE DISCLOSURE

The present disclosure is directed to providing an ink jet recording apparatus capable of suppressing overflow of ink from an absorber even if the apparatus is arranged at an angle.

According to an aspect of the present disclosure, an ink jet recording apparatus configured to perform recording operation by ejecting ink from a recording head includes a first absorber configured to absorb ink, a second absorber disposed apart from the first absorber having a larger ink absorption capacity than the first absorber, and a flow path portion that does not absorb ink. The second absorber has a second lower end portion arranged below a first lower end portion of the first absorber. The flow path portion connects the first lower end portion and a portion of the second absorber below the first lower end portion.

Further features and aspects of the present disclosure will become apparent from the following description of example embodiments with reference to the attached drawings.

DESCRIPTION OF THE EMBODIMENTS

First Example Embodiment

A first example embodiment of the present disclosure will be described below with reference to the drawings. However, the following example embodiments do not limit the present disclosure, and not all combinations of the features described in the present example embodiments are necessarily essential to means to solve the issues of the present disclosure. Further, the relative arrangements, shapes, and the like of the constitution elements described in the example embodiments are merely examples, and are not intended to limit the scope of the present disclosure thereto.

<Example Configuration of Apparatus>

Figure 1A:
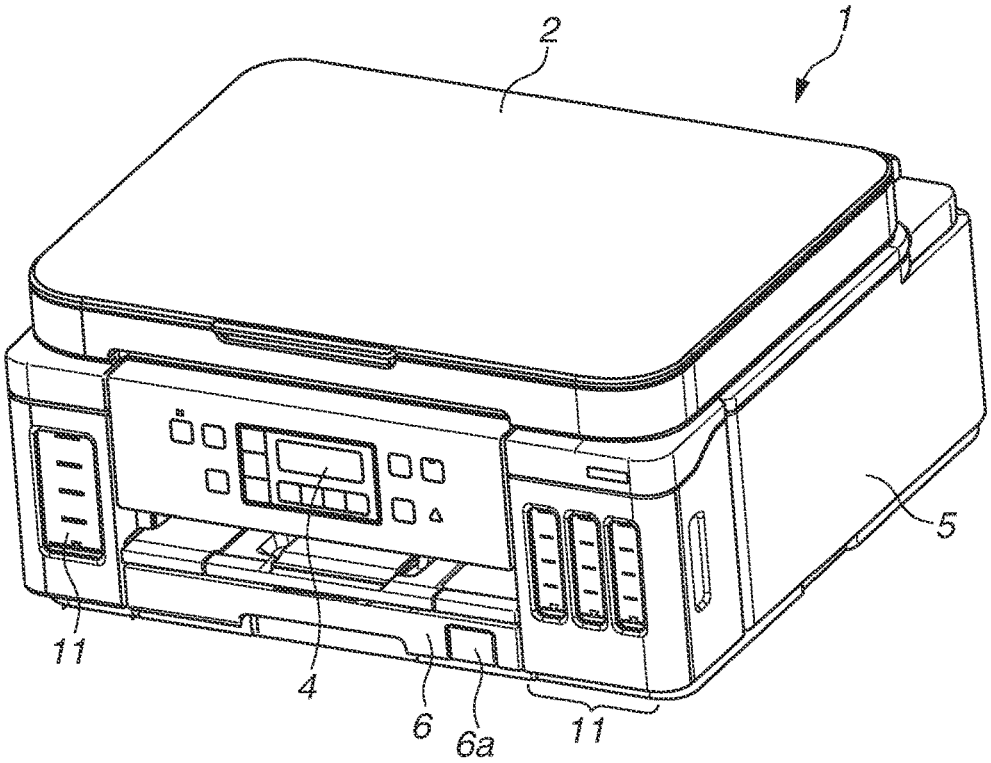
FIGS. 1A and 1B are external perspective views of an ink jet recording apparatus according to a first example embodiment.

FIG. 1A is an external perspective view illustrating an ink jet recording apparatus (hereinafter, recording apparatus) 1 according to the present example embodiment. The recording apparatus 1 includes a housing 5, a recording head 3 configured to perform a recording operation on a recording medium (see FIGS. 2A and 2B), and an ink tank 11 as an ink storage container configured to store ink to be supplied to the recording head 3. In the present example embodiment, the ink tank 11 is disposed on a front side of the housing 5 and is fixed to an apparatus main body. Similarly, on the front side of the housing 5, an operation unit 4 is provided. The operation unit 4 allows user to perform an operation such as inputting a command to the recording apparatus 1. The operation unit 4 according to the present example embodiment also includes a display panel configured to display an error in the recording apparatus 1 and the like.

A sheet feed cassette 6 that can be inserted into and removed from the housing 5 by the user is provided on the front side of the housing 5. The sheet feed cassette 6 is provided with a window portion 6*a* so that the user can visually recognize the recording medium loaded in the sheet feed cassette 6. It is desirable that the window portion 6*a* is made of a transparent member such as glass or plastic.

Figure 1B:
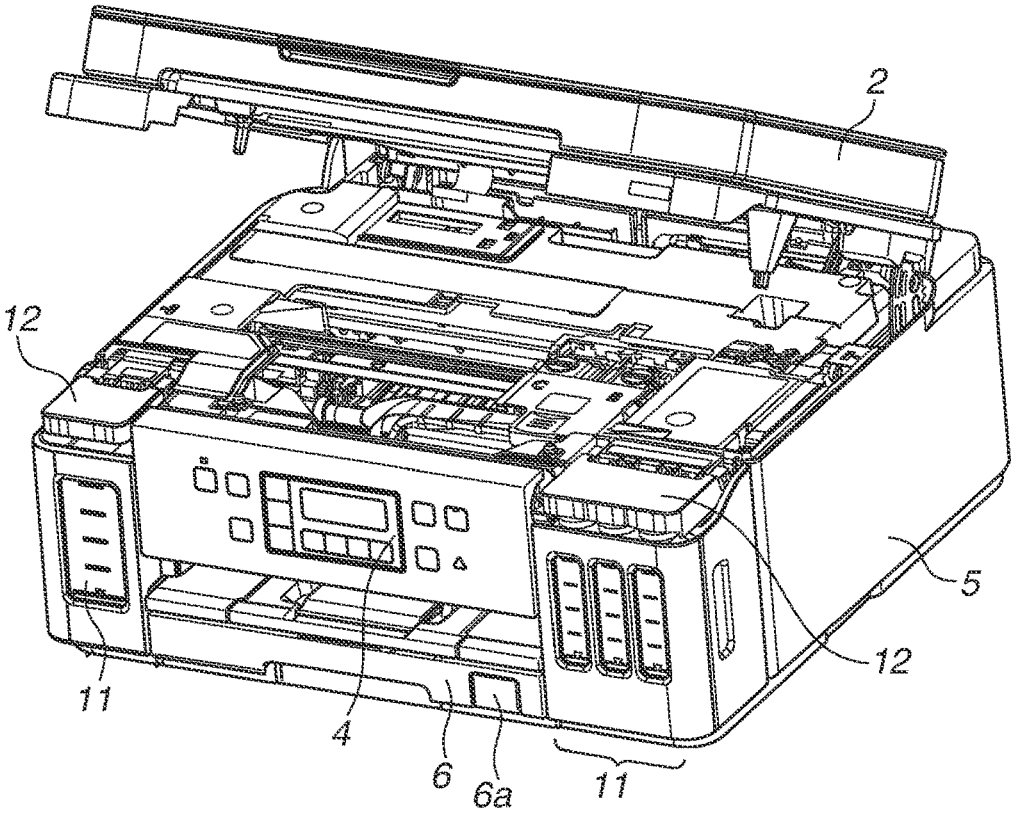

At an upper portion of the housing 5, a scanner unit 2 configured to perform a document reading operation is provided, and the scanner unit 2 is openable with respect to the housing 5. FIG. 1B is an external perspective view of the recording apparatus 1 illustrating a state where the scanner unit 2 is opened with respect to the housing 5. If the scanner unit 2 is opened, a tank cover 12 that can cover an upper surface of the ink tank 11 is exposed. In FIG. 1B, the tank cover 12 is in a closed state. Details of the tank cover 12 will be described below. A configuration may be adopted in which a main body cover on which the scanner unit 2 is not mounted is openable with respect to the housing 5.

Figure 2A:
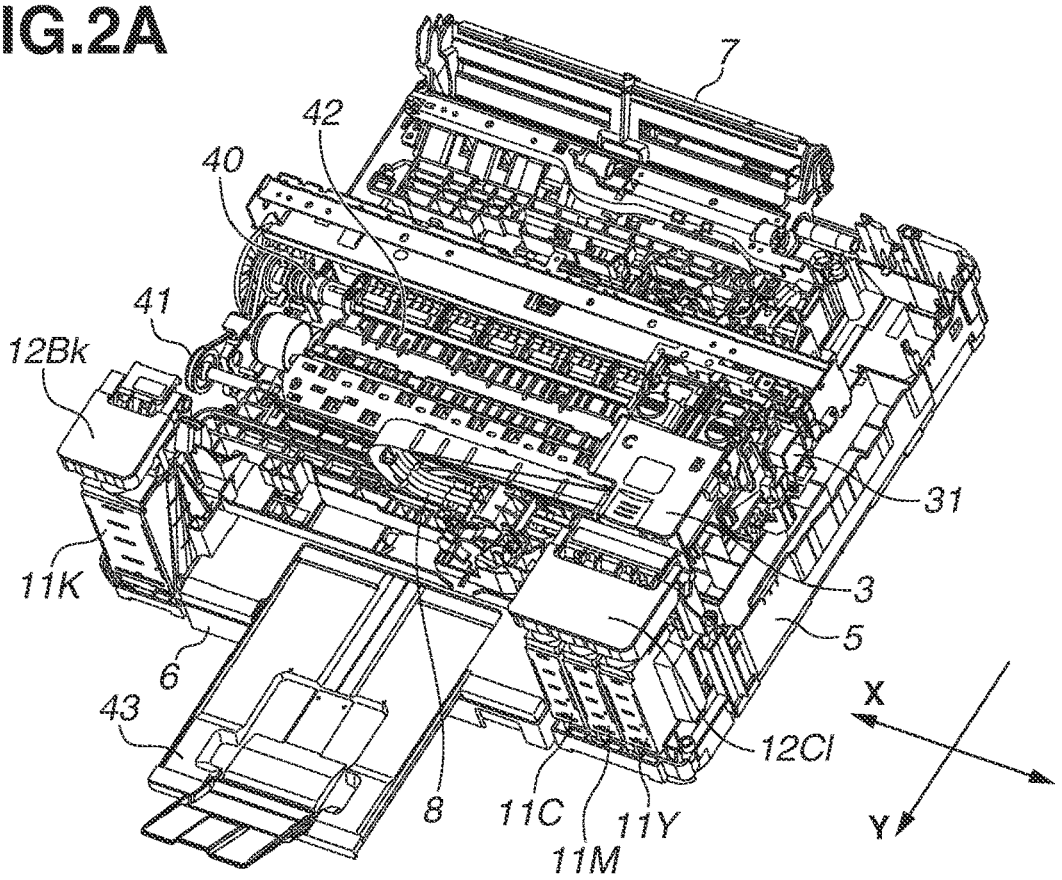
FIGS. 2A and 2B are perspective views illustrating an internal configuration of the ink jet recording apparatus according to the first example embodiment.
Figure 2B:
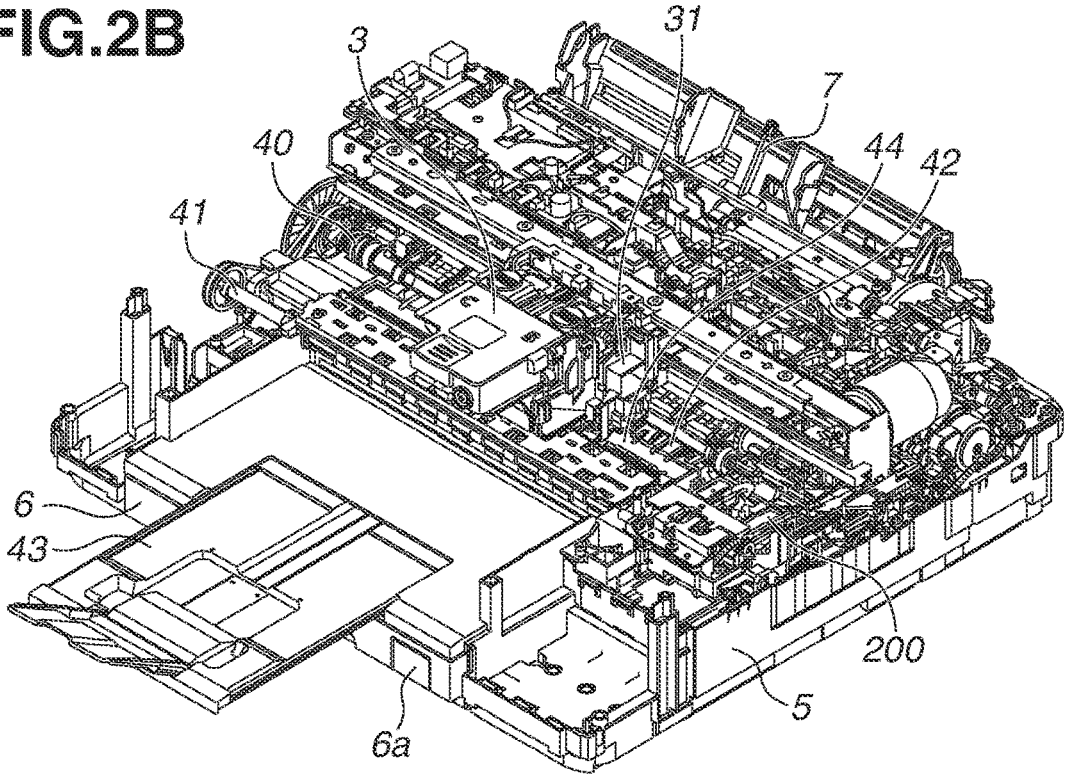

FIG. 2A is a perspective view illustrating an internal configuration of the recording apparatus 1 and FIG. 2B is a perspective view illustrating the internal configuration of the recording apparatus 1 from which the ink tank 11 is removed. In the recording apparatus 1, a feeding unit (not illustrated) feeds the recording medium loaded on the sheet feed cassette 6 provided on the front side of the housing 5 or a sheet feed tray 7 provided on a rear side of the housing 5. The recording medium fed by the feeding unit is conveyed by a conveyance roller (conveyance unit) 40 onto a platen 42 disposed at a position facing the recording head 3. The platen 42 is a member configured to guide and support the recording medium to be recorded by the recording head 3. The recording medium on which recording by the recording head 3 is completed is discharged onto a sheet discharge tray (discharging portion) 43 by a discharge roller (discharging unit) 41. The sheet discharge tray 43 is disposed over the sheet feed cassette 6.

A direction in which the recording medium is conveyed by the conveyance roller 40 (Y direction illustrated in FIGS. 2A and 2B) is referred to as a conveyance direction. That is, an upstream side in the conveyance direction corresponds to a rear side of the housing 5, and a downstream side in the conveyance direction corresponds to a front side of the housing 5.

The recording head 3 is mounted on a carriage 31 configured to reciprocally move (reciprocally scan) in a main scanning direction (X direction illustrated in FIGS. 2A and 2B) intersecting the conveyance direction. In the present example embodiment, the conveyance direction is orthogonal to the main scanning direction. The recording head 3 ejects ink droplets while moving in the main scanning direction together with the carriage 31 to record an image for one band on a recording medium (recording operation). Once the image for one band is recorded, the recording medium is conveyed by a predetermined amount in the conveyance direction by the conveyance roller 40 (intermittent conveyance operation). By repeating the recording operation for one band and the intermittent conveyance operation, an image is recorded on the entire recording medium based on recording data.

The recording apparatus 1 is provided with a recovery unit 200 in a scanning area of the carriage 31 and outside of a recording area where the recording operation is performed by the recording head 3. The recovery unit 200 is configured to perform a recovery operation for maintaining the ejection performance of the recording head 3, and is disposed at a position that allows the recovery unit 200 to face an ejection port surface on which an array of ink ejection ports is arranged. The recording head 3 illustrated in FIG. 2A is located at a recovery position (home position) where the recovery operation can be performed by the recovery unit 200. Details of the recovery unit 200 will be described below.

In the present example embodiment, an example of a serial head is illustrated in which the recording head 3 is mounted on the carriage 31, however, the present disclosure is not limited thereto, and is also applicable to a line head in which a plurality of ejection ports is arranged in a region corresponding to a width of a recording medium.

The ink tank 11 is provided in the recording apparatus 1 for each color of ink ejected by the recording head 3. In the present example embodiment, four ink tanks, which are a black ink tank 11K, a cyan ink tank 11C, a magenta ink tank 11M, and a yellow ink tank 11Y are provided, and these ink tanks are collectively referred to as the ink tank 11. Cyan, magenta, and yellow are merely examples of color ink, and the ink is not limited thereto.

As illustrated in FIG. 2A, the black ink tank 11K is disposed on a left side of the sheet discharge tray 43 and the sheet feed cassette 6 when viewed from the front of the recording apparatus 1. On the other hand, the cyan ink tank 11C, the magenta ink tank 11M, and the yellow ink tank 11Y are disposed on a right side of the sheet discharge tray 43 and the sheet feed cassette 6 when viewed from the front of the recording apparatus 1. That is, the sheet discharge tray 43 and the sheet feed cassette 6 are provided between the black ink tank 11K and the color ink tanks. Each ink tank 11 is connected to the recording head 3 by a flexible supply tube 8 that forms a supply channel for supplying ink to the recording head 3.

Further, the recording apparatus 1 is provided with a black tank cover 12Bk and a color tank cover 1201. The black tank cover 12Bk covers an upper surface of the black ink tank 11K. On the other hand, the color tank cover 12Cl integrally covers upper surfaces of the cyan ink tank 11C, the magenta ink tank 11M, and the yellow ink tank 11Y. Hereinafter, the black tank cover 12Bk and the color tank cover 12Cl are collectively referred to as the tank cover 12.

<Example Ink Filling Operation>

FIGS. 3A to 3D are external perspective views of a tank unit 10 including the ink tank 11 and a configuration in the vicinity of the ink tank 11. Since a basic configuration of the tank unit 10 is common to each ink color, a black tank unit will be described as an example.

Figure 3A:
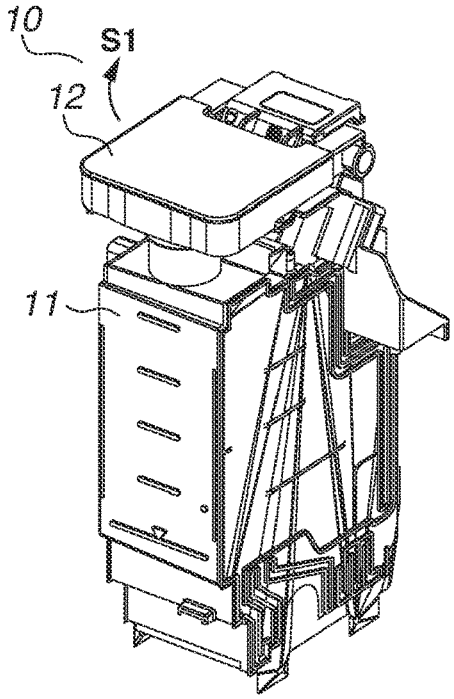
FIGS. 3A, 3B, 3C, and 3D are external perspective views of a tank unit according to the first example embodiment.
Figure 3B:
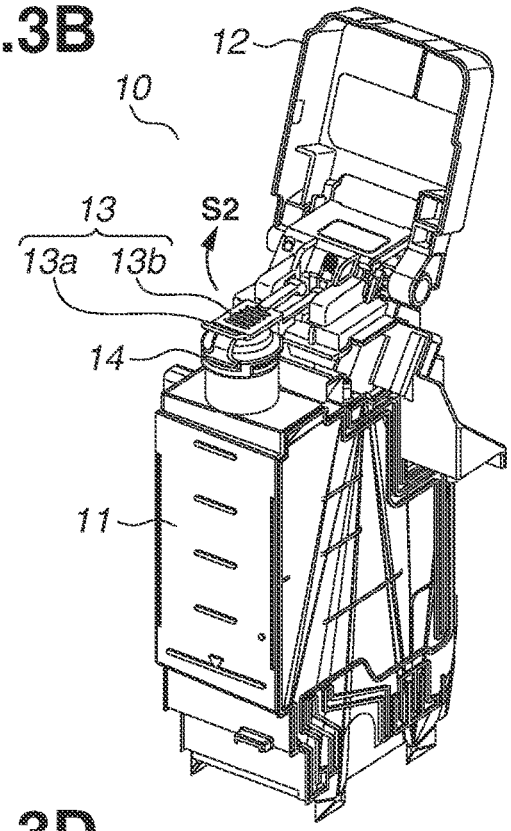
Figure 3C:
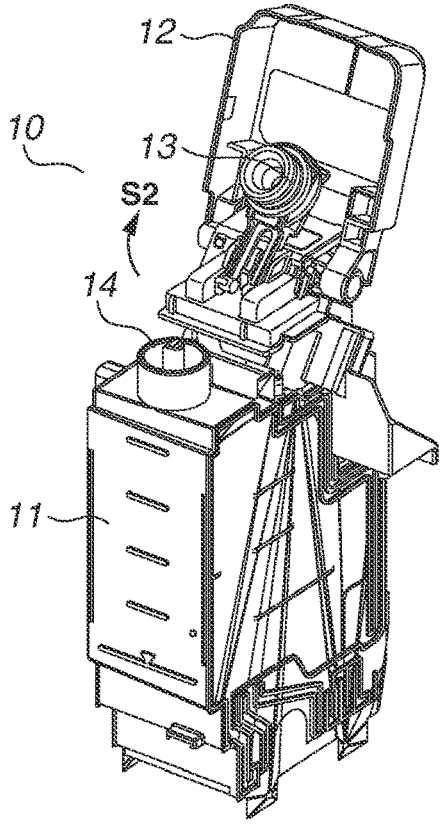

FIG. 3A illustrates a state where the tank cover 12 is closed and FIG. 3B illustrates a state where the tank cover 12 is opened. The user can access a tank cap 13 by opening the tank cover 12 in an S1 direction.

A filling portion 14 for filling ink is provided on the upper surface of the ink tank 11, and the filling portion 14 can be sealed by the tank cap 13. The tank cap 13 includes a cap portion 13*a* for sealing the filling portion 14, and a lever portion 13*b* that supports the cap portion 13*a* and can be operated by the user. The lever portion 13*b* is revolvably supported with respect to a main body of the recording apparatus 1. The user can fill ink by removing the cap portion 13*a* from the filling portion 14 while turning the lever portion 13*b* in an S2 direction illustrated in FIG. 3B (see FIG. 3C). The lever portion 13*b* may be revolvably supported with respect to the ink tank 11 or the tank cover 12.

The cap portion 13*a* of the tank cap 13 is formed of a member having rubber elasticity, and the lever portion 13*b* is formed of plastic or the like. The lever portion 13*b* according to the present example embodiment is color-coded to a color corresponding to the color of the ink stored in the ink tank 11. That is, the lever portion 13*b* for black ink is color-coded to black or gray, the lever portion 13*b* for cyan ink is color-coded to cyan, the lever portion 13*b* for magenta ink is color-coded to magenta, and the lever portion 13*b* for yellow ink is color-coded to yellow. As a result, when the user fills the ink into the ink tank 11, it is possible to prevent ink of the wrong color from being filled. Not only the lever portion 13*b* but also the cap portion 13*a* may be color-coded.

Figure 3D:
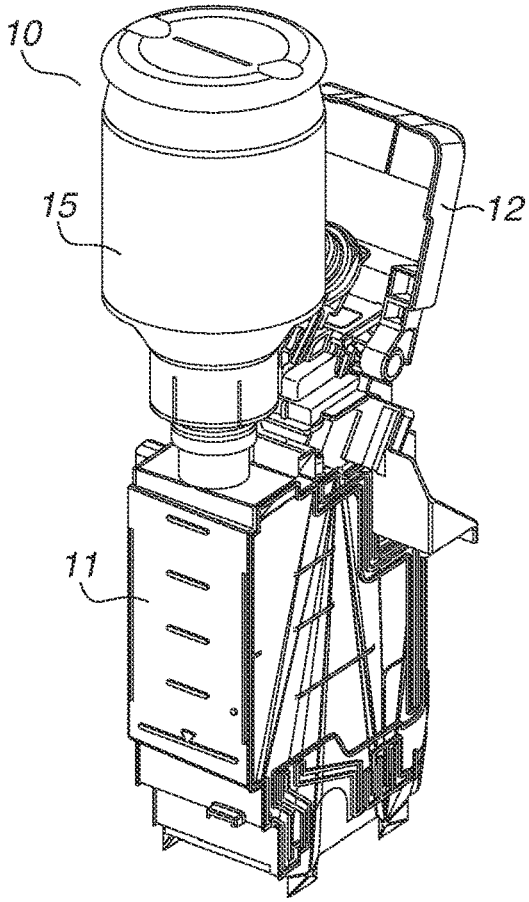

FIG. 3D illustrates a state where the ink is filled by inserting an ink bottle 15 being an ink replenishing container, into the filling portion 14 in a state where the tank cap 13 is removed. In the present example embodiment, the ink in the ink bottle 15 is filled into the ink tank 11 as a result of gas-liquid exchange between the ink and the air in the ink tank 11.

In the present example embodiment, a mode has been described in which the ink is supplied from the ink tank 11 to the recording head 3 by the supply tube 8. However, the present disclosure is not limited thereto, and is also applicable to a so-called on-carriage mode in which the ink tank 11 is mounted on the carriage 31 together with the recording head 3. Further, the present disclosure is not limited to a configuration in which the ink can be filled into the ink tank 11, and a mode is possible in which a detachable ink cartridge is attached to the main body of the recording apparatus 1 or the carriage 31. That is, the present disclosure is not limited regarding the method of supplying ink to the recording head 3.

Further, in the present example embodiment, a so-called serial head that is mounted on the carriage 31 and performs recording while moving reciprocally has been described as an example. However, the present disclosure is not limited thereto, and is also applicable to a line head provided with a plurality of ejection ports corresponding to the width of the recording medium.

<Example Recovery Unit>

Figure 4:
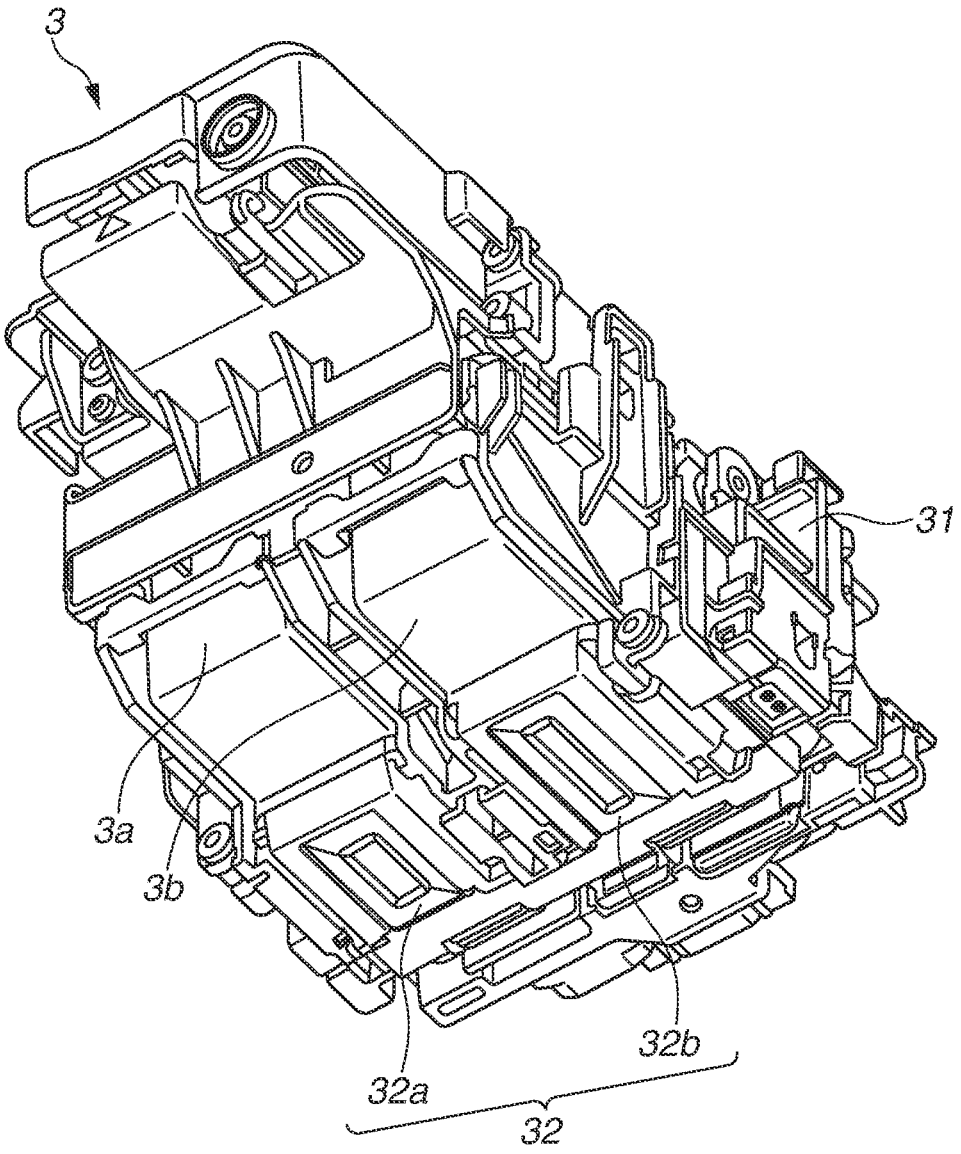
FIG. 4 is a perspective view of a recording head according to the first example embodiment.

FIG. 4 is a perspective view of the recording head 3 viewed from a side of the ejection port surface. The recording head 3 according to the present example embodiment includes a color recording head 3*a* configured to eject color ink and a black recording head 3*b* configured to eject black ink. Cyan, magenta, and yellow can be ejected as the color ink. A lower surface of the color recording head 3*a* is provided with a color ejection port surface 32*a* in which a plurality of ejection ports ejecting color ink is arranged, and a lower surface of the black recording head 3*b* is provided with a black ejection port surface 32*b* in which a plurality of ejection ports ejecting black ink is arranged.

Figure 5:
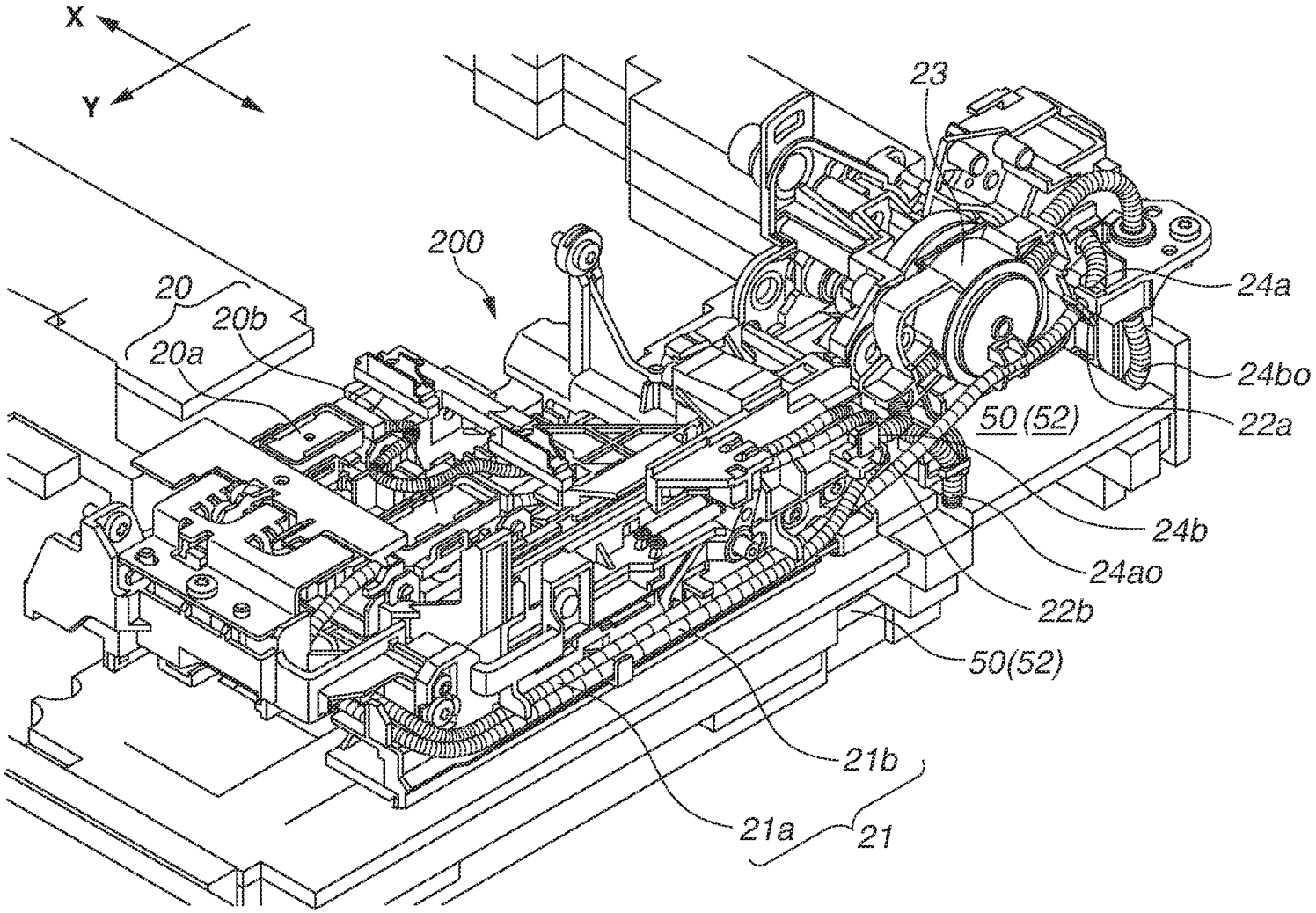
FIG. 5 is a perspective view illustrating details of a recovery unit according to the first example embodiment.

FIG. 5 is a perspective view illustrating a detailed configuration of the recovery unit 200. The recovery unit 200 includes a color cap 20*a* configured to tightly seal the color ejection port surface 32*a* and a black cap 20*b* configured to tightly seal the black ejection port surface 32*b*. Each cap 20 is movable between a capping position in which the ejection port surface 32 is tightly sealed (capped) and a separation position in which the cap 20 is separated from the ejection port surface 32. The cap 20 protects the ejection port and suppresses evaporation of ink in the ejection port by tightly sealing the ejection port surface 32 when the recording head 3 does not perform the recording operation.

The color cap 20*a* is connected to a waste ink storage unit 50 via a color cap tube 21*a* and a color pump tube 24*a*. The color cap tube 21*a* and the color pump tube 24*a* are connected by a color joint 22*a*. Similarly, the black cap 20*b* is connected to the waste ink storage unit 50 via a black cap tube 21*b* and a black pump tube 24*b*. The black cap tube 21*b* and the black pump tube 24*b* are connected by a black joint 22*b*. The waste ink storage unit 50 is laid under the recovery unit 200 so as to entirely cover an area under the recovery unit 200.

An outlet 24*ao* of the color pump tube 24*a* and an outlet 24*bo* of the black pump tube 24*b* are arranged apart from each other in the conveyance direction. This is to prevent color ink which is a dye ink and black ink which is a pigment ink from mixing and reacting with each other and from accumulating in the waste ink storage unit 50. In the present example embodiment, the outlet 24*bo* of the black pump tube 24*b* is arranged upstream (rear side of the recording apparatus 1) of the outlet 24*ao* of the color pump tube 24*a* in the conveyance direction.

A shared suction pump 23 is provided for the color pump tube 24*a* and the black pump tube 24*b*. By driving the suction pump 23, ink is sucked from the color cap 20*a* and the black cap 20*b*, and is discharged to the waste ink storage unit 50.

The recovery operation includes a suction operation in which ink is sucked from the ejection port by driving the suction pump 23 in a state where the ejection port surface 32 is tightly sealed by the cap 20. By the suction operation, bubbles in the ejection port and thickened ink can be forcibly sucked and discharged. Further, the recovery operation includes a preliminary ejection operation of ejecting ink that is not intended for the recording operation in a state where the ejection port surface 32 faces the cap 20. The recording head 3 according to the present example embodiment performs the preliminary ejection on the cap 20, however, an ink receiving portion that receives the preliminarily ejected ink may be provided separately from the cap 20. In the preliminary ejection operation, the thickened ink at the ejection port can be forcibly discharged. The ink preliminarily ejected to the cap 20 is discharged from the cap 20 to the waste ink storage unit 50 by driving the suction pump 23.

Among the components of the recovery unit 200, particularly the cap 20 is provided within the scanning area of the carriage 31 and outside the recording area of the recording head 3. Other components such as the cap tube 21, the pump tube 24, and the suction pump 23 are provided outside the recording area of the recording head 3.

<Example Waste Ink Storage Unit>

Figure 6A:
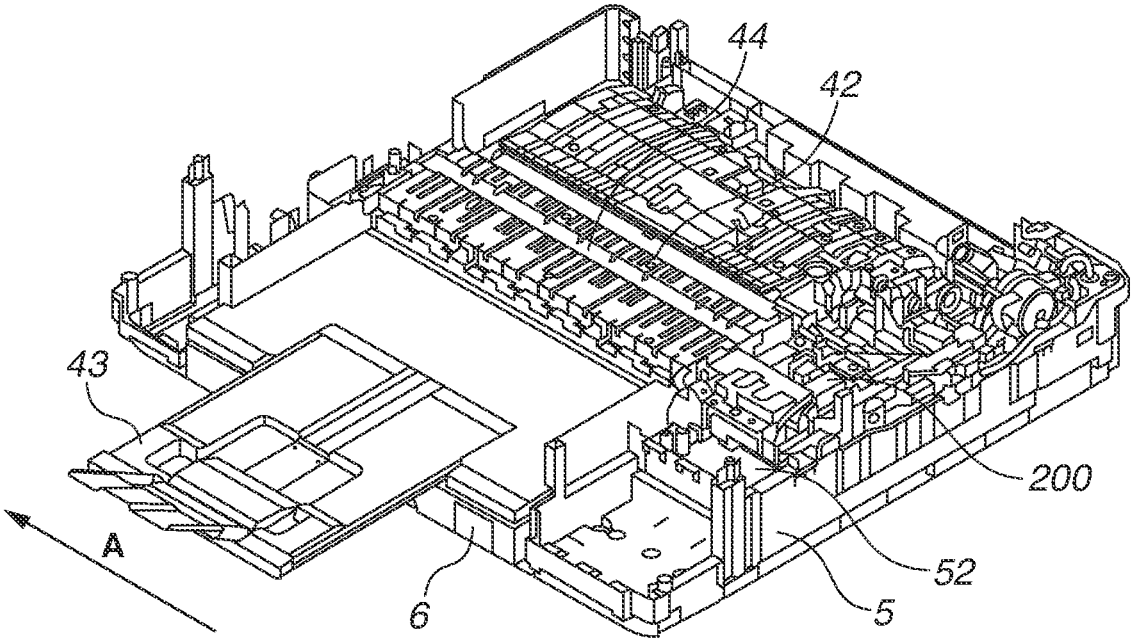
FIGS. 6A and 6B are external perspective views of the ink jet recording apparatus according to the first example embodiment.

FIG. 6A is a perspective view of a lower portion of the recording apparatus 1 from which members of the recording head 3 and so on from FIGS. 2A and 2B are omitted. The recording head 3 can execute marginless recording that is recording without providing a margin on the recording medium, and during the marginless recording, ejected ink may reach a region outside the recording medium. Thus, the platen 42 is provided with an ink receiver 44 capable of absorbing ink ejected to the outside of the recording medium, for marginless recording. The ink receiver 44 is arranged so as to extend throughout the recording area of the recording head 3 and so as to have a similar height to a support surface of the recording medium on the platen 42.

Figure 6B:
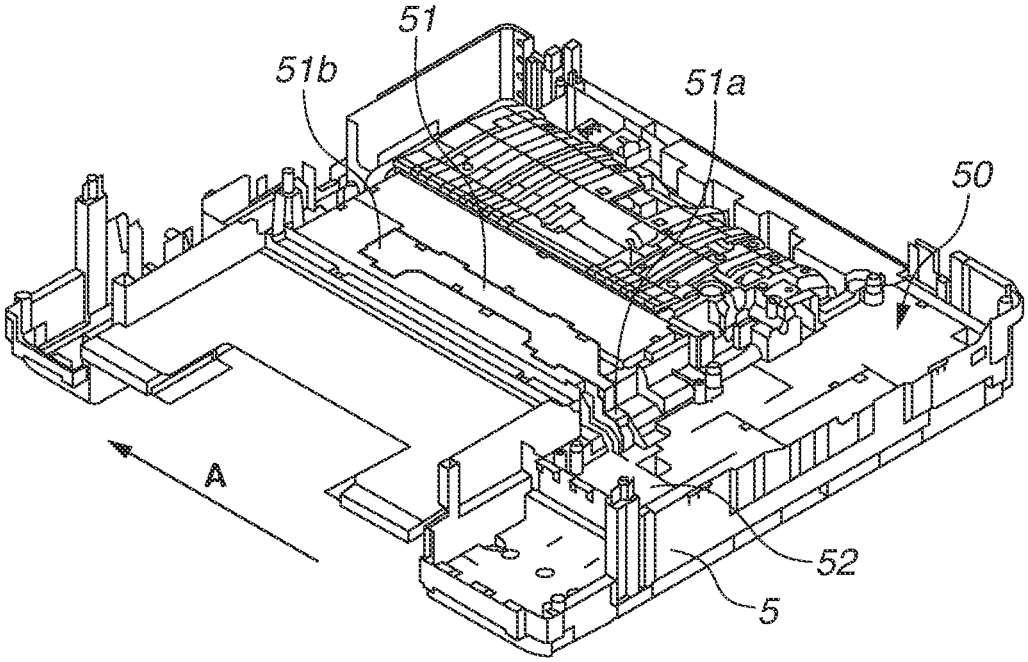

FIG. 6B is a perspective view of the lower portion of the recording apparatus 1 in which members such as the platen 42, the ink receiver 44, and the recovery unit 200 are omitted from FIG. 6A. The waste ink storage unit 50 includes a first absorber 51 disposed under the platen 42 and the ink receiver 44, and a second absorber 52 disposed under the recovery unit 200 and having a larger volume than the first absorber 51. The second absorber 52 can absorb a larger amount of ink than the first absorber 51. Further, the first absorber 51 and the second absorber 52 are both porous bodies that can absorb and hold a liquid such as ink.

The first absorber 51 is provided so as to contact the ink receiver 44, and is capable of absorbing the ink received by the ink receiver 44. Since the first absorber 51 is disposed under the platen 42 and the ink receiver 44 and over the sheet feed cassette 6 and the sheet discharge tray 43, the first absorber 51 has a shape of a thin plate and is small in volume, and thus the amount of ink that the first absorber 51 can hold (absorption capacity) is smaller compared to the second absorber 52. On the other hand, the second absorber 52 is arranged with respect to the housing 5 so as to entirely cover an area under the recovery unit 200, and can absorb the ink discharged from the pump tube 24.

Since the first absorber 51 has a small capacity and can hold only a small amount of ink, the ink absorbed by the first absorber 51 is transferred and absorbed by the second absorber 52 to prevent the ink from overflowing from the first absorber 51. A configuration for absorbing ink from the first absorber 51 to the second absorber 52 will be described below.

Figure 7:
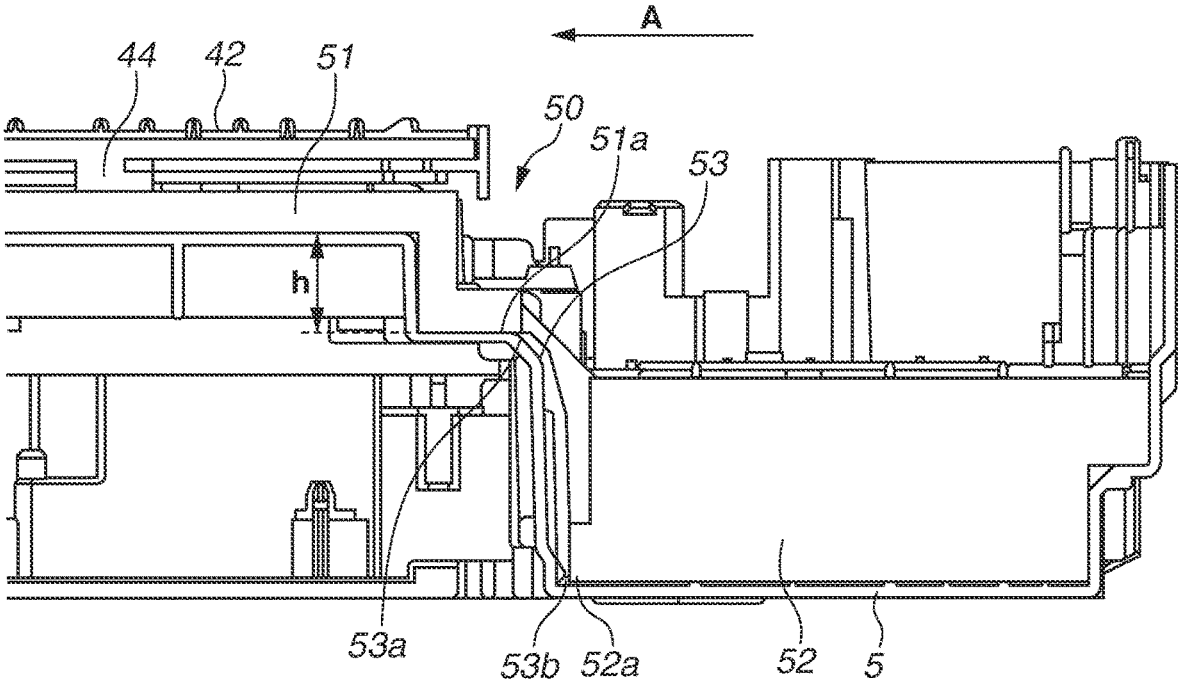
FIG. 7 is a cross-sectional view of a waste ink storage unit according to the first example embodiment.

FIG. 7 is a cross-sectional view of the recording apparatus 1 viewed from the front, and illustrates a connection configuration of the first absorber 51 and the second absorber 52. In a use state in which the recording apparatus 1 is normally used, a second lower end portion 52*a* of the second absorber 52 is arranged to be positioned below a first lower end portion 51*a* of the first absorber 51. Further, a flow path portion 53 as a connecting portion is formed in the housing 5 between the first absorber 51 and the second absorber 52. The flow path portion 53 is formed integrally with the housing 5 using a resin or the like that cannot absorb a liquid such as ink.

As illustrated in FIG. 7, the first lower end portion 51*a* of the first absorber 51 is formed partially lower by a height h. Thus, the first lower end portion 51*a* having a low water head and a small volume is formed in the first absorber 51 to promote the movement of the ink toward the first lower end portion 51*a*. Further, since the amount of ink that can be held in the first lower end portion 51*a* is small, the ink easily overflows from the first lower end portion 51*a*. Thus, compared to a case where the first lower end portion 51*a* is not formed, the movement of the ink from the first absorber 51 to the flow path portion 53 is promoted.

Figure 8:
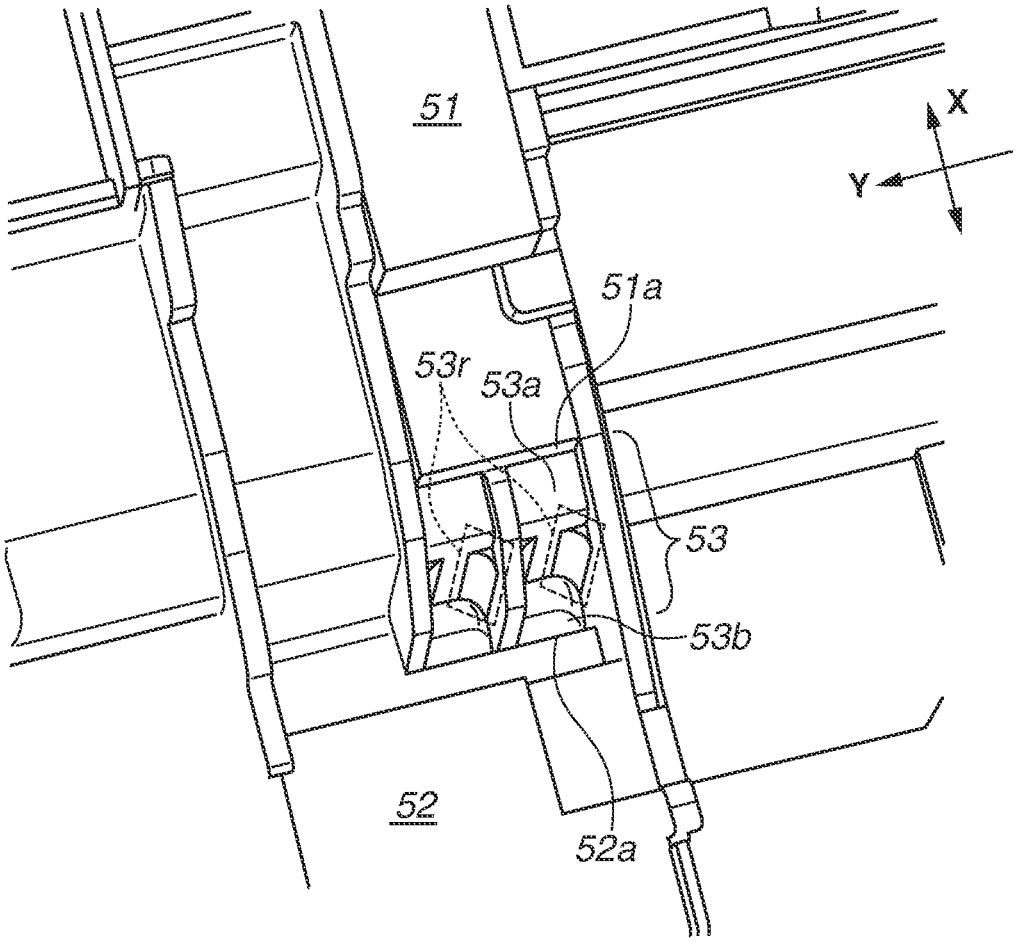
FIG. 8 is a top view of the waste ink storage unit according to the first example embodiment.

FIG. 8 is an enlarged top view centered on the flow path portion 53. An upper end 53*a* of the flow path portion 53 contacts the first lower end portion 51*a* of the first absorber 51, and a lower end 53*b* of the flow path portion 53 contacts the second lower end portion 52*a* of the second absorber 52. That is, the flow path portion 53 connects the first lower end portion 51*a* of the first absorber 51 and the second lower end portion 52*a* of the second absorber 52.

If marginless recording is performed by the recording head 3, ink is ejected to the ink receiver 44 and the ink is absorbed by the first absorber 51. If the amount of the absorbed ink exceeds the volume of the first absorber 51, the ink overflows from the first lower end portion 51*a* having a low water head. Then, the overflowed ink moves from the upper end 53*a* to the lower end 53*b* located at a lower position in the flow path portion 53 and is absorbed by the second absorber 52.

In the configuration described above, if the recording apparatus 1 is arranged such that an A direction illustrated in FIGS. 6A, 6B, and 7 is the direction of gravity, the second lower end portion 52*a* of the second absorber 52 is located above the first absorber 51. At this time, if the first absorber 51 and the second absorber 52 contact each other or the first absorber 51 and the second absorber 52 are connected by another absorber, the ink of the second absorber 52 moves to the first absorber 51 due to the capillary force of the absorber. Thus, if the amount of ink that can be held by the first absorber 51 is exceeded, the ink may overflow from a lower end portion 51*b* of the first absorber 51 in the A direction.

However, by adopting a configuration such as in the present example embodiment, where the first absorber 51 and the second absorber 52 do not contact each other and are connected by the flow path portion 53 that cannot absorb ink, the ink hardly moves from the second absorber 52 to the first absorber 51. This is because the movement of the ink due to the capillary force of the absorber is suppressed. Further, this is because the amount of ink that can be held by the second absorber 52 is larger than that of the first absorber 51, and the ink hardly flows out from the second absorber 52 to the flow path portion 53. Therefore, even if the recording apparatus 1 is arranged such that the A direction is the direction of gravity, it is possible to prevent the ink from overflowing from the lower end portion 51*b* of the first absorber 51 in the A direction.

As described above, by arranging the first absorber 51 having a small absorption capacity and the second absorber 52 having a large absorption capacity so as not to contact each other and connecting the first absorber 51 and the second absorber 52 by the flow path portion 53 that cannot absorb ink, the ink overflowing from the first absorber 51 can be absorbed by the second absorber 52. Further, even if the recording apparatus 1 is left in a posture different from a posture during normal use, it is possible to prevent the ink from moving from the second absorber 52 to the first absorber 51 and from overflowing from the first absorber 51.

Further, as illustrated in FIG. 8, the flow path portion 53 is configured so that the upper end 53*a* of the flow path portion 53 has an angular shape having an angular edge and the lower end 53*b* of the flow path portion 53 has a round shape having no angular edges. In general, in the angular shape, the ink easily moves along the edge due to the capillary force, however, in the round shape, no capillary force is exerted and the ink hardly moves. Therefore, in the upper end 53*a*, the ink easily moves along the angular shape formed by a side wall and a bottom plate forming the flow path. Thus, the movement of the ink overflowing from the first absorber 51 is promoted toward the flow path portion 53. On the other hand, by choosing the round shape for the lower end 53*b*, the movement of the ink from the second absorber 52 to the flow path portion 53 is reduced.

As illustrated in FIG. 8, in the flow path portion 53 according to the present example embodiment, a flow path of an intermediate portion 53*r* connecting the upper end 53*a* and the lower end 53*b* has also an round shape. The intermediate portion 53*r* is a portion lower than the upper end 53*a*. That is, during normal use of the recording apparatus 1, the upper end 53*a* having the angular shape causes the ink to move to the intermediate portion 53*r*, and then, the ink moves to the lower end 53*b* due to the water head difference. On the other hand, for example, if the recording apparatus 1 is placed such that the A direction is the direction of gravity, the ink hardly moves to the upper end 53*a* due to the round shape of the lower end 53*b* and the intermediate portion 53*r*. Thus, the movement of the ink from the second absorber 52 to the first absorber 51 can be reduced while the movement of the ink from the first absorber 51 to the second absorber 52 is promoted.

Figure 9A:
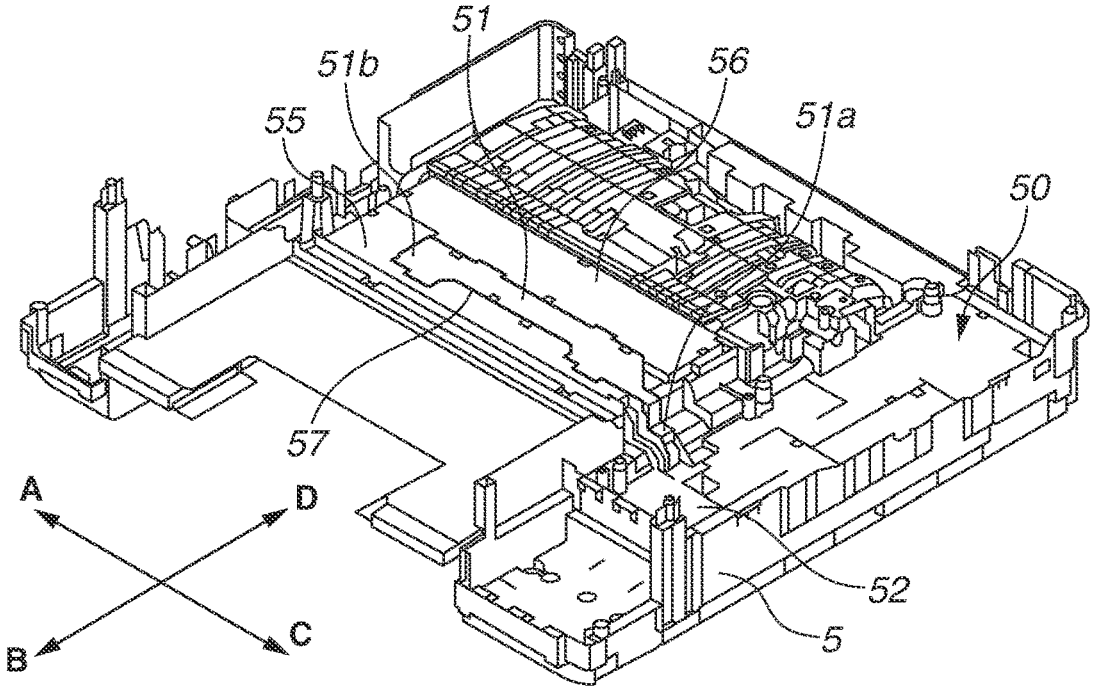
FIGS. 9A and 9B are external perspective views of the ink jet recording apparatus according to the first example embodiment.

FIG. 9A is an external perspective view of the recording apparatus 1 for describing a configuration in the vicinity of the first absorber 51 in detail. In addition to the A direction illustrated in FIGS. 6A and 6B, there is a case where the recording apparatus 1 is oriented so that any one of B, C, and D directions is the direction of gravity. The A to D directions are planar directions intersecting (orthogonal to) the direction of gravity during normal use of the recording apparatus 1. In the present example embodiment, a partition 57 that surrounds the circumference of the first absorber 51 is provided to prevent the ink from overflowing from the first absorber 51 even if the recording apparatus 1 is oriented in various directions. The partition 57 has substantially the same height as the first absorber 51. Further, a third absorber 55 is provided adjacent to the partition 57 and downstream of the first absorber 51 in the conveyance direction, and a fourth absorber 56 is provided adjacent to the partition 57 and upstream in the conveyance direction.

Since the first absorber 51 has the shape of a thin plate having a small thickness in a height direction (direction of gravity), if the recording apparatus 1 is installed so that any one of the A to D directions is the direction of gravity, the area of the lower side of the first absorber 51 becomes small, and thus, the ink easily overflows. On the other hand, since the thickness of the second absorber 52 in the height direction is greater than that of the first absorber 51, even if the recording apparatus 1 is installed so that any one of the A to D directions is the direction of gravity, the area of the lower side of the second absorber 52 is large and thus, the ink hardly overflows. Therefore, by making the area of the first absorber 51 as small as possible, the movement of the ink to the second absorber 52 can be promoted, and the ink is prevented from overflowing.

Since it is necessary to reliably absorb the ink ejected in the marginless recording, the first absorber 51 has an area similar to that of the platen 42. The partition 57 is a member defining first absorber 51 so as to have an area corresponding to the platen 42, and the first absorber 51 is formed in a shape corresponding to a region surrounded by the partition 57.

With the above-described configuration, in a normal use state of the recording apparatus 1, most of the ink absorbed by the first absorber 51 moves to the second absorber 52 via the flow path portion 53. On the other hand, if the recording apparatus 1 is installed so that any one of the B to D directions is the direction of gravity, the ink may slightly overflow outside of the partition 57. Thus, by providing the third absorber 55 and the fourth absorber 56 around the partition 57, the ink is prevented from overflowing in the recording apparatus 1.

Figure 9B:
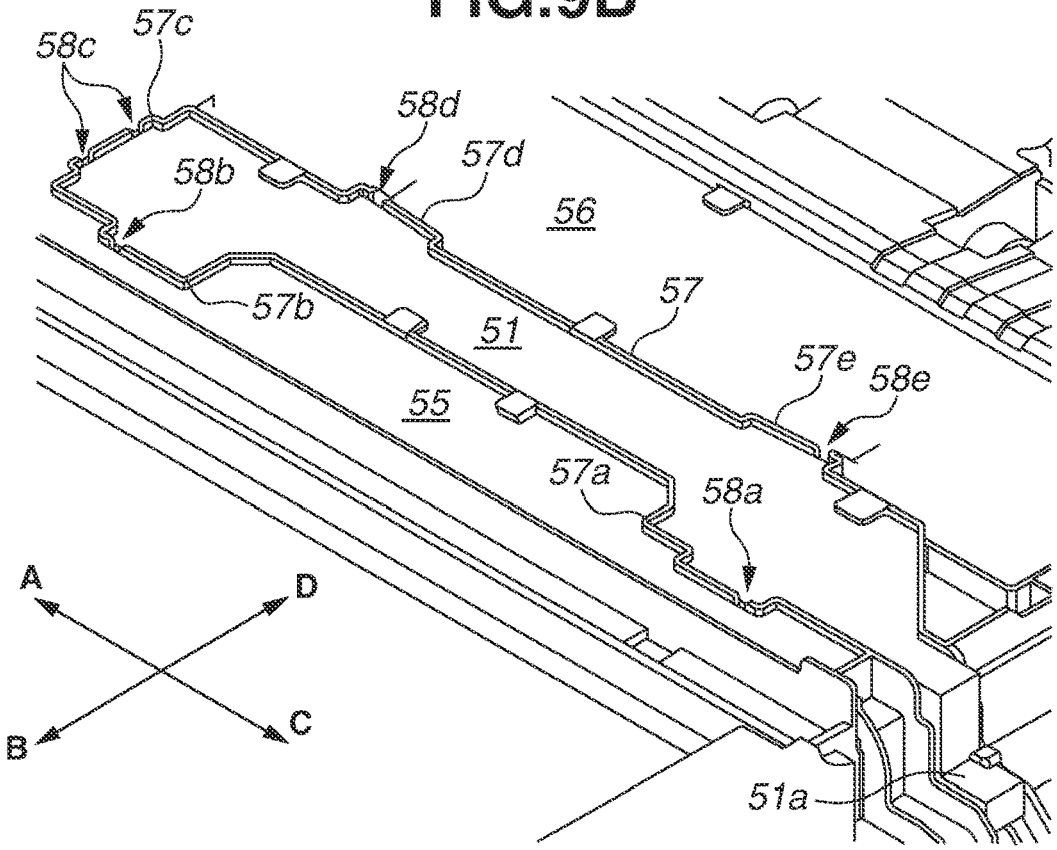

FIG. 9B is an enlarged perspective view illustrating a detailed configuration of the partition 57. The partition 57 includes a first projection portion 57*a* and a second projection portion 57*b* projecting in the B direction, a third projection portion 57*c* projecting in the A direction, and a fourth projection portion 57*d* and a fifth projection portion 57*e* projecting in the D direction. Further, these projection portions are provided with a first cutout portion 58*a* to a fifth cutout portion 58*e*, respectively.

The first projection portion 57*a* and the second projection portion 57*b* are portions being the lowermost surface if the recording apparatus 1 is installed so that the B direction is the direction of gravity, and are provided with the first cutout portion 58*a* and the second cutout portion 58*b*, respectively. That is, if the ink moves in the direction of gravity (B direction) inside the first absorber 51, the ink is concentrated in the first projection portion 57*a* and the second projection portion 57*b* and moved to the third absorber 55 via the first cutout portion 58*a* and the second cutout portion 58*b*. By adopting the configuration that guides the movement direction of the ink as described above, the volume of the third absorber 55 can be effectively used.

Similarly, the third projection portion 57*c* is a portion being the lowermost surface if the recording apparatus 1 is installed so that the A direction is the direction of gravity, and is provided with the third cutout portion 58*c*. Thus, if the ink moves in the direction of gravity (A direction) inside the first absorber 51, the ink is concentrated in the third projection portion 57*c* and moved to the third absorber 55 via the third cutout portion 58*c*.

Further, the fourth projection portion 57*d* and the fifth projection portion 57*e* are portions being the lowermost surface if the recording apparatus 1 is installed so that the D direction is the direction of gravity, and are provided with the fourth cutout portion 58*d* and the fifth cutout portion 58*e*, respectively. Thus, if the ink moves in the direction of gravity (D direction) inside the first absorber 51, the ink is concentrated in the fourth projection portion 57*d* and the fifth projection portion 57*e* and moved to the fourth absorber 56 via the fourth cutout portion 58*d* and the fifth cutout portion 58*e*. As described above, even if the recording apparatus 1 is oriented in various directions, it is possible to suppress the inside of the recording apparatus 1 from being contaminated by the ink overflowing from the first absorber 51.

In the present example embodiment, although the flow path portion 53 is configured to connect the first lower end portion 51*a* of the first absorber 51 and the second lower end portion 52*a* of the second absorber 52, the present disclosure is not limited thereto. That is, since it is sufficient that the flow path portion 53 is configured to cause the movement of the ink from the first lower end portion 51*a* by utilizing the water head difference, the flow path portion 53 may have any configuration in which the lower end 53*b* of the flow path portion 53 is connected to the second absorber 52 at a position below the first lower end portion 51*a*.

However, as in the present example embodiment, if a configuration is adopted in which the flow path portion 53 connects the first lower end portion 51*a* and the second lower end portion 52*a*, the ink absorbed by the second absorber 52 tends to be concentrated at a lower portion of the second absorber 52. Thus, for example, if an impact is received by a main body of the recording apparatus 1, the ink can be prevented from scattering outside of the second absorber 52, compared to a case where a large amount of ink is absorbed in an upper portion of the second absorber 52.

Second Example Embodiment

Figure 10:
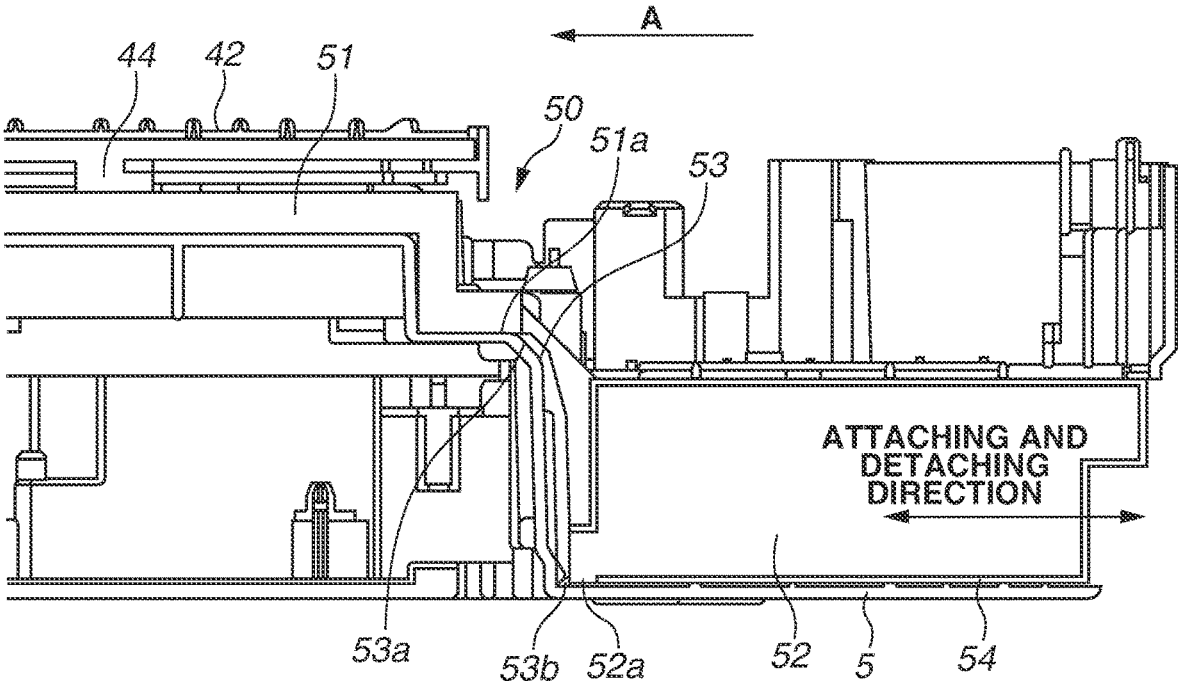
FIG. 10 is a cross-sectional view of a waste ink storage unit according to a second example embodiment.

FIG. 10 is a cross-sectional view of the recording apparatus 1 according to a second example embodiment viewed from the front, and illustrates a connection configuration of the first absorber 51 and the second absorber 52. In the first example embodiment, the second absorber 52 is arranged directly with respect to the housing 5 and under the recovery unit 200. However, in the second example embodiment, the second absorber 52 is arranged in a waste ink cartridge 54 detachable from the housing 5.

Thus, if the amount of ink absorbed by the second absorber 52 exceeds a threshold value, the waste ink cartridge 54 can be removed from the recording apparatus 1 along an attaching and detaching direction illustrated in FIG. 10 and replaced with a waste ink cartridge 54 provided with an unused second absorber 52. The attaching and detaching direction is, for example, a direction that is the same as the conveyance direction. In the second example embodiment, the second absorber 52 is also configured to be connected to the first absorber 51 via the flow path portion 53 without directly contacting the first absorber 51, and thus, the user can easily attach and detach the waste ink cartridge 54.

Other Example Embodiments

Figure 11:
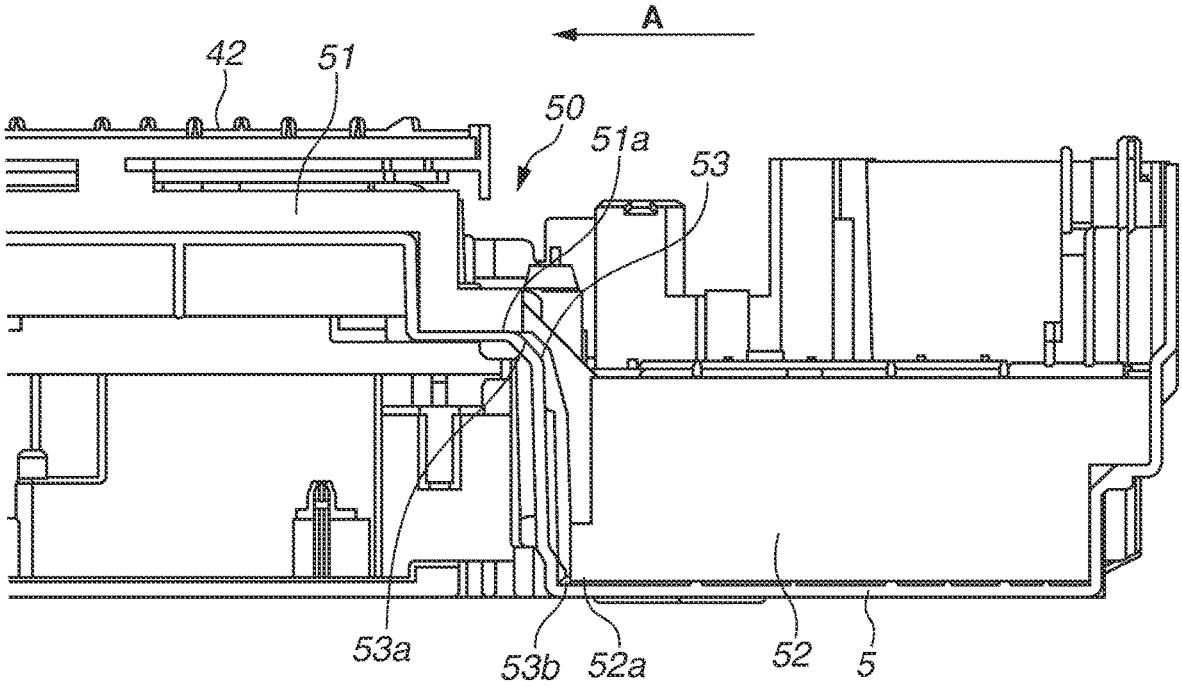
FIG. 11 is a cross-sectional view of a waste ink storage unit according to another example embodiment.
Figure 12:
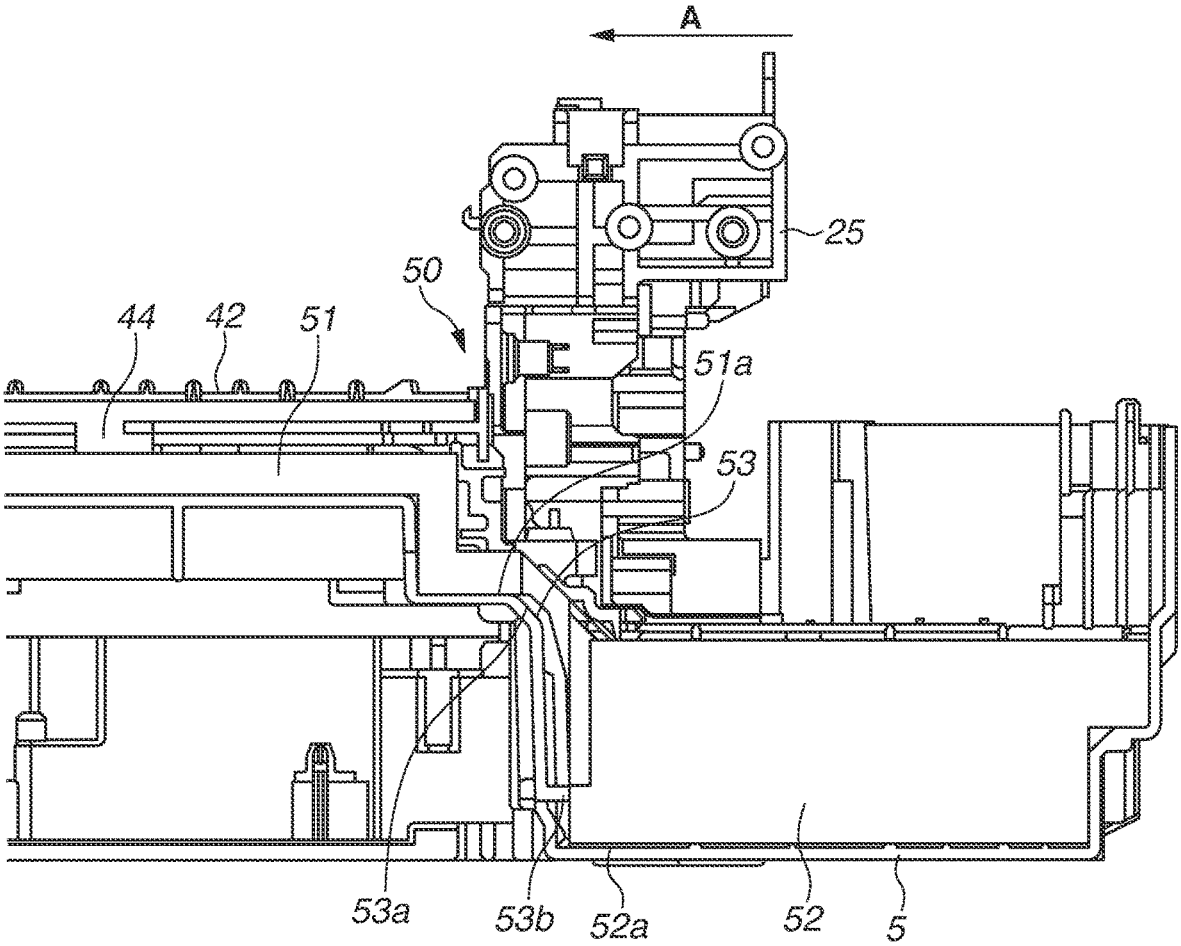
FIG. 12 is a cross-sectional view of a waste ink storage unit according to another example embodiment.

FIGS. 11 and 12 are cross-sectional views of the recording apparatus 1 viewed from the front and illustrate a connection configuration of the first absorber 51 and the second absorber 52. FIG. 11 illustrates a state where the ink receiver 44 provided to the platen 42 in the first example embodiment is formed integrally with the first absorber 51. Thus, the present disclosure is also applicable to a mode in which the ink receiver 44 and the first absorber 51 are integrally formed.

Further, FIG. 12 illustrates a state where the recovery unit 200 is held by a holding member 25. Instead of the flow path portion 53 formed in the housing 5 as in the first example embodiment, even if the flow path portion 53 is formed on the holding member 25, a similar effect can be achieved.

In the above-described example embodiment, a mode in which the ink moves from the first absorber 51 to the second absorber 52 has been described. However, the present disclosure is not limited thereto, and is also applicable to a mode in which the ink moves from a plurality of absorbers to one absorber, and a mode in which the ink moves from one absorber to a plurality of absorbers.

Further, in the above-described example embodiment, although an example has been described in which the ink ejected during marginless recording is absorbed by the first absorber 51, the present disclosure is not limited thereto and a mode is possible in which the first absorber 51 absorbs ink leaking from an ink tank or a joint portion of an ink flow path, for example.

That is, according to the present disclosure, it is possible to provide an ink jet recording apparatus capable of suppressing overflow of ink from an absorber even if the apparatus is arranged at an angle.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-071349, filed Apr. 3, 2019, which is hereby incorporated by reference herein in its entirety.

What is claimed is:

1. An ink jet recording apparatus configured to perform recording operation by ejecting ink from a recording head, the ink jet recording apparatus comprising:

a first absorber configured to absorb ink; a second absorber disposed apart from the first absorber and having a larger ink absorption capacity than the first absorber, the second absorber having a second lower end portion arranged below a first lower end portion of the first absorber;

a flow path portion that does not absorb ink, the flow path portion connecting the first lower end portion and a portion of the second absorber below the first lower end portion;

a recovery unit configured to perform a recovery operation for maintaining an ejection performance of the recording head, wherein the second absorber is disposed under the recovery unit; and wherein the recovery unit includes a cap configured to cover an ejection port surface of the recording head, a suction unit configured to suck ink from the cap, and a tube configured to connect the cap and the suction unit.

2. The ink jet recording apparatus according to claim 1, wherein the flow path portion connects the first lower end portion and the second lower end portion.

3. The ink jet recording apparatus according to claim 1, further comprising a platen disposed at a position facing the recording head, the platen being configured to support a recording medium, wherein the first absorber is disposed under the platen.

4. The ink jet recording apparatus according to claim 3, further comprising a discharging portion to which a recording medium on which recording by the recording head is completed is discharged, wherein the first absorber is disposed over the discharging portion.

5. The ink jet recording apparatus according to claim 1, wherein the first absorber has a shape of a thin plate.

6. The ink jet recording apparatus according to claim 1, wherein the recording head is configured to eject color ink and black ink, and wherein the tube includes a first tube configured to be used in discharging color ink and a second tube configured to be used in discharging black ink.

7. The ink jet recording apparatus according to claim 6, wherein the color ink is a dye ink, and the black ink is a pigment ink, and wherein the first tube is configured such that discharge of ink from the first tube to the second absorber is performed at a position separated from the second tube.

8. The ink jet recording apparatus according to claim 1, further comprising a carriage on which the recording head is mounted, the carriage being configured to perform reciprocal scanning, wherein the cap is provided outside a recording area where the recording operation is performed by the recording head and within a scanning area of the carriage.

9. The ink jet recording apparatus according to claim 1, wherein the second absorber has a greater thickness in a direction of gravity than the first absorber.

10. The ink jet recording apparatus according to claim 1, wherein the first absorber is defined by a partition including a projection portion projecting in a plane direction intersecting a direction of gravity and a cutout portion provided in the projection portion.

11. The ink jet recording apparatus according to claim 10, further comprising:

a conveyance unit configured to convey a recording medium to the recording head in a conveyance direction;

a third absorber disposed downstream of the first absorber in the conveyance direction and adjacent to the partition; and a fourth absorber disposed upstream of the first absorber in the conveyance direction and adjacent to the partition.

12. The ink jet recording apparatus according to claim 1, wherein the flow path portion includes an upper end that is in contact with the first absorber and has an angular shape, and a lower end that is in contact with the second absorber and has a round shape having no angular edges.

13. The ink jet recording apparatus according to claim 12, wherein the flow path portion further includes an intermediate portion having a round shape and connecting the lower end and the upper end.

14. The ink jet recording apparatus according to claim 1, further comprising the recording head.

* * * * *